United States Patent [19]

Becker

[11] Patent Number: 5,005,327

[45] Date of Patent: Apr. 9, 1991

[54] CONTAINER, PARTICULARLY A SILO CONTAINER

[76] Inventor: Markus Becker, Habichtsteiner Weg 20, D-3501 Habichtswald/Ehlen, Fed. Rep. of Germany

[21] Appl. No.: 428,887

[22] Filed: Oct. 30, 1989

[30] Foreign Application Priority Data

Nov. 4, 1988 [DE] Fed. Rep. of Germany ..... 3837475

[51] Int. Cl.[5] ..... E04H 7/00

[52] U.S. Cl. ..... 52/192; 52/284; 52/730

[58] Field of Search ..... 52/648, 730, 731, 192, 52/284, 584

[56] References Cited

U.S. PATENT DOCUMENTS

| | | | |
|---|---|---|---|
| Re. 30,108 | 10/1979 | Oliver | 52/192 X |
| 90,116 | 5/1869 | Mills | 52/192 |
| 852,105 | 4/1907 | Clement | 52/192 |
| 3,279,140 | 10/1966 | Oliver | 52/584 |
| 3,375,631 | 4/1968 | Oliver | 52/584 |
| 4,291,510 | 9/1981 | Sivachenko | 52/284 X |
| 4,893,445 | 1/1990 | Hefer et al. | 52/731 X |

FOREIGN PATENT DOCUMENTS

| | | |
|---|---|---|
| 0077267 | 4/1983 | European Pat. Off. . |
| 3626786 | 2/1987 | Fed. Rep. of Germany . |

*Primary Examiner*—David A. Scherbel
*Assistant Examiner*—L. J. Watson
*Attorney, Agent, or Firm*—Collard, Roe & Galgano

[57] ABSTRACT

A container, particularly a silo container, is provided consisting of a plurality of wall parts having horizontal through-extending crimps, at least two wall parts form a joint wherein the wall parts are connected with each other within the zone of the joint by at least one vertically standing support element, the legs of the support element, which is in the form of a metal support plate, within the zone of the joint have matching crimps for positively receiving the wall parts having the horizontal crimps.

15 Claims, 5 Drawing Sheets

CONTAINER, PARTICULARLY A SILO CONTAINER

The present invention relates to a container and, more particularly it relates to a silo container consisting of a plurality of wall parts having horizontal crimps, wherein at lest two wall parts form a joint and the wall parts are connected with each other within the zone of the joint by at least one vertical support element.

Silo containers frequency consist of separate silo chambers or bins for receiving different types of bulk materials, for example different types of grain. The side walls of such silos are formed with crimps and are supported by square supports each having a strip on the side facing the wall which is shaped to conform with the contour of the wall part formed with crimps, so that a positive or formlocked connection is provided in the vertical direction.

In the horizontal joints of such silos, the individual wall elements of a wall part, such elements being arranged one above the other, are secured together by screws or welding. The manufacture of such silos is quite costly because so much welding is required due to the way the strips are arranged on the support. In addition, it is difficult, it at all possible, to galvanize such supports fitted with strips. Such galvanizing, however, is absolutely necessary for rust protection. Furthermore, a relatively large amount of space is needed for shipping the supports, which additionally increases the costs of such containers.

Another drawback is the costly installation work due to the fact that the individual wall elements of a wall part must be joined with each other at their horizontal joints by means of screws or welding.

The container disclosed in European Patent 0,007,267 has wall parts with vertical crimps. Moreover, no formlocked or positive connection is provided between the wall parts and the corner supports in the vertical direction.

A silo bin construction is disclosed in German patent document DE-OS 36 26 786 wherein the wall parts have tub-shaped crimps for stiffening the bin in the lengthwise direction. The wall parts are planar within the zone of the joints in order to permit their connection by means of matching support plates. With this design, the support plates are secured to the wall parts by screws. A drawback is that the manufacturing cost is relatively high, as the crimps can be incorporated in the metal sheets only with the help of a press. In addition, the installation of transverse metal plates so as to produce individual chambers in a silo bin is possible only at the joints of the plates. This design has the further drawback that the wall elements forming a wall part are secured together in their horizontal joints by means of screws.

It is, therefore, the object of the present invention to provide a silo container having a construction that avoids the aforementioned drawbacks.

This object is accomplished in accordance with the present invention by providing a silo container wherein the legs of the support elements, each of which is in the form of a metal support plate, within the zone of the joint, have matching crimps for positively receiving in a form-locked manner the wall parts which are themselves fitted with through-extending horizontal crimps.

According to the present invention, the individual wall parts consist of a plurality of wall elements arranged one above the other, the wall elements having horizontal, through-extending crimps of approximately trapezoidal cross-section. In each joint with an angular shape, i.e., in each 90-degree joint, the metal support plate, which connectes adjacent wall parts diagonally, itself has an approximately trapezoidal cross-section. Each leg of such a metal support plate includes crimps arranged one above the other which have a shape matching the crimps of the wall parts, so that the latter are engaged by the legs in a form-locked manner in the vertical direction.

In a joint where four wall parts standing vertically relative to each other form a juncture, a hollow space is created in that the four wall parts are engaged by four vertically standing support plates, each of which engages a pair of adjacent wall parts diagonally.

A hollow space is formed in joints having an angular shape as well if an angularly bent corner metal plate is additionally mounted on each of the two adjacent wall parts, whereby the outwardly projecting legs of such corner plates are engaged by a U-profile.

In such an embodiment, the leg of the corner plate abutting the wall part consists of a plurality of crimps arranged one above the other, such crimps having a shape matching the form of the crimps of the wall part, so that the wall parts are engaged by the legs of the corner plate in a form-locked manner as well. This embodiment has the advantage that for producing the corner plates, it is only necessary that the support plates with the trapezoidal cross-section be cut into halves, which means that the outwardly projecting leg of the corner plate has a smooth wall.

The supporting plates and corner plates so designed and arranged on the wall parts assure both horizontal and vertical load support.

According to another feature of the invention, the wall parts form a space between each other within the zone of the joint. This space is selected in such a way that the ends of the wall parts do not project into the hollow space formed by the support and corner plates. This hollow space may be filled with concrete for enhancing the stability of the container. Screws are utilized for fastening the support plates to the wall parts.

Another advantage of this construction is obtained if the height of the bridge of the crimp of a wall part, a supporting plate, or a corner plate, conforms to the height of the legs of the given crimp projected onto the plane, taking into account the thickness of the metal sheet. In this case, it is possible, for example, to arrange two wall parts disposed at right angles relative to each other displaced against each other by exactly the height of the bridge of a crimp. In this way, pockets are formed where the crimps of the wall parts merge into the associated crimps of the support plates and corner plates. Said pockets are filled with concrete as well, which results in a support effect that increases the load absorption in the vertical direction.

An additional advantage is that only one type of support and corner plate is needed, i.e., no right and left support plates, which would be required if the wall parts disposed in one plane opposite the other wall parts were not disposed alternately to each other in height, namely exactly by the height of the bridge of a crimp.

With this design of a silo container it is also beneficial that the length of the wall parts need not be limited, aside from transportation requirements. The embodiment or design of the support plates permits joining of the wall parts at any desired point without requiring any break in the wall parts, as found, for example, with support elements in the form of square supports.

According to a special embodiment, the wall elements arranged one above the other form of a positive or form-locked connection. For producing such a form-locked connection, each wall element has claws or table on one horizontal edge, and matching openings on the other, opposite edge, such openings being roof-shaped, i.e., they are closed both on top and on both sides. Such roof-like design of the openings results in a tight connection between two wall elements.

According to a particularly advantageous embodiment, the wall element having the openings overlaps the wall elements with the claws beyond the zone of the edge of the crimps, so that a form-locked connection is produced between the individual wall elements in the vertical direction as well. In this way, due to the form-locked connection between the individual wall elements, such a wall part is capable of discharging vertical loads across the entire height.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
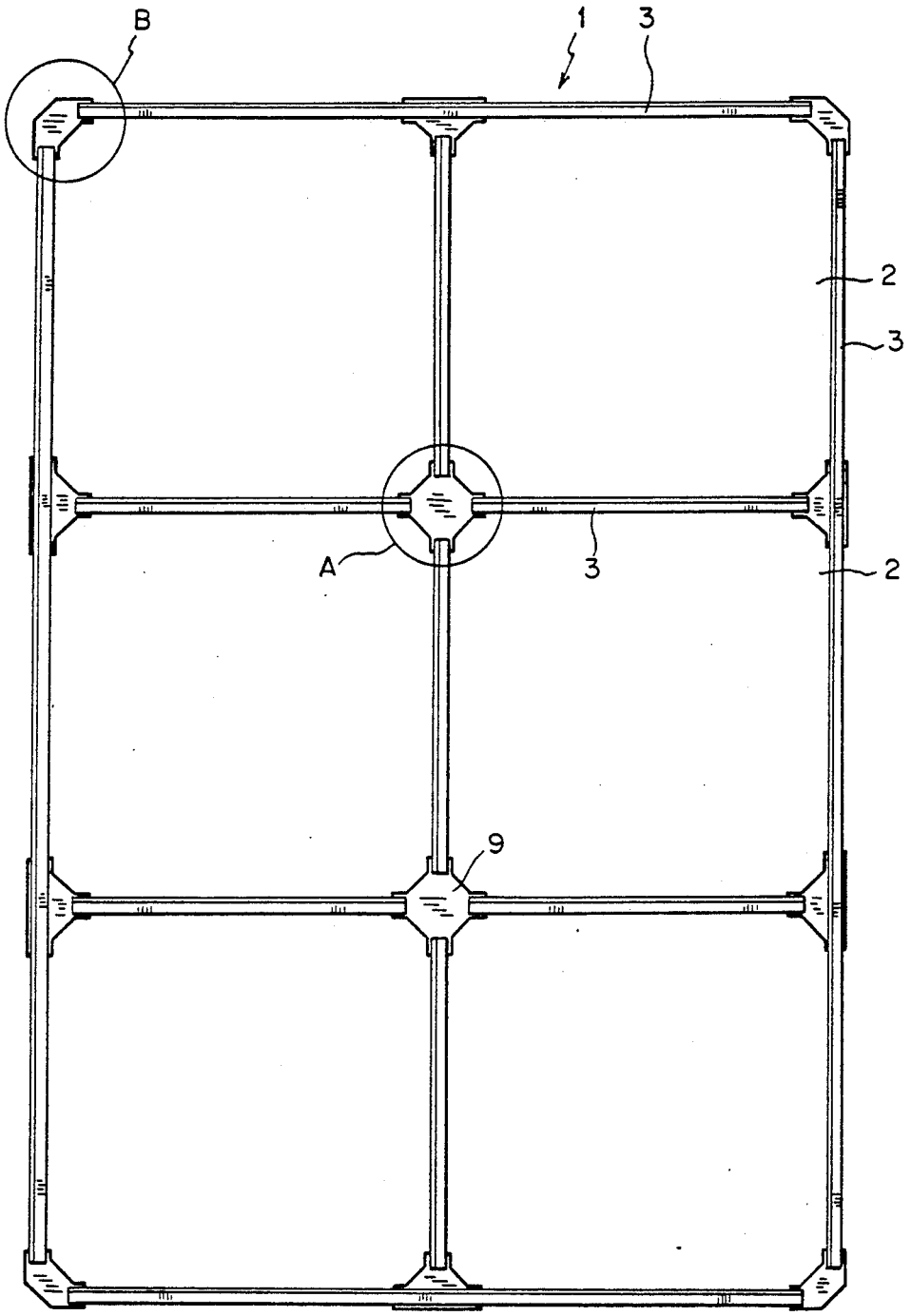
FIG. 1 is a top plan view of a silo container according to the present invention consisting of a plurality of chambers or compartments.

Now turning to the drawings, there is shown in FIG. 1 a silo container denoted by reference numeral 1 consisting of a plurality of compartments or chambers 2, which are separated from each other. The individual chambers, including the container itself, are formed by wall parts 3, wherein the outer wall parts are through-extending. Such a container consisting of a plurality of chambers has joints in angular form, e.g. corner points and intersection points.

Figure 2:
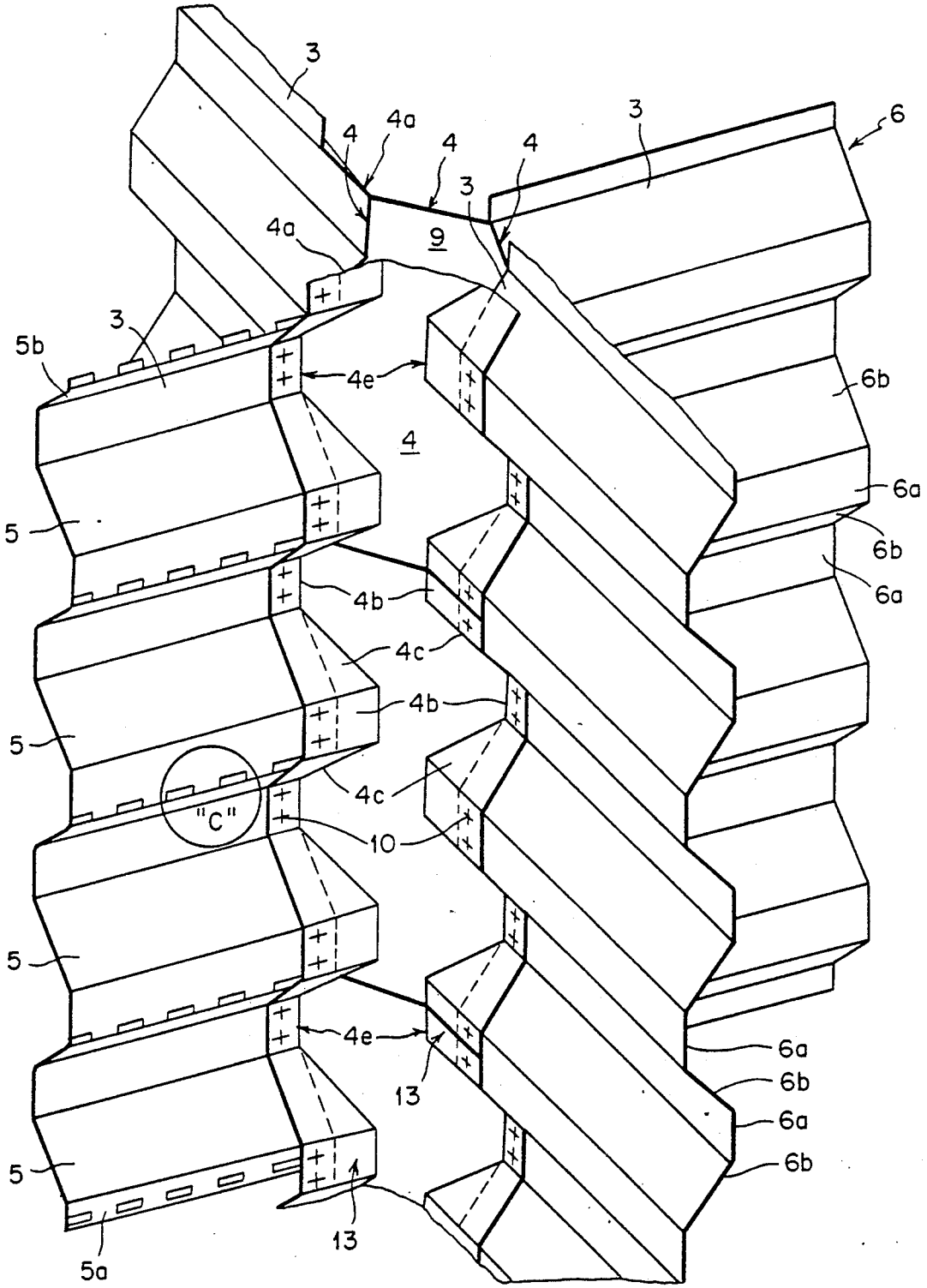
FIG. 2 is a perspective view of detail A of FIG. 1 shown as a cutout.

Such an intersection point is shown in perspective in FIG. 2. The individual wall parts 3 of this embodiment are connected with each other by four diagonally arranged metal support plates 4 having a trapezoidal cross-section. Wall parts 3 consist of individual wall elements 5 arranged one above the other, each of which having horizontal crimps 6 of trapezoidal shape. Legs 4*a* of support plates 4 are shaped to match the form of crimps 6 of wall elements 5. Thus, legs 4*a* include crimps 4*e* arranged one above the other, permitting legs 4*a* of the metal support plates to engage wall parts 3 in a form-locked way. This form-locked connection between metal support plates 4 and wall parts 3 makes it possible to discharge via support plates 4 the vertical forces acting on wall parts 3. The individual support plates themselves are connected with wall parts 3 by means of screws 10.

By diagonally arranging individual support plates 4 between two wall parts 3 in each case, a hollow space 9 is formed within the zone of the joint or juncture of the wall parts, which space can be filled with concrete.

Figure 3:
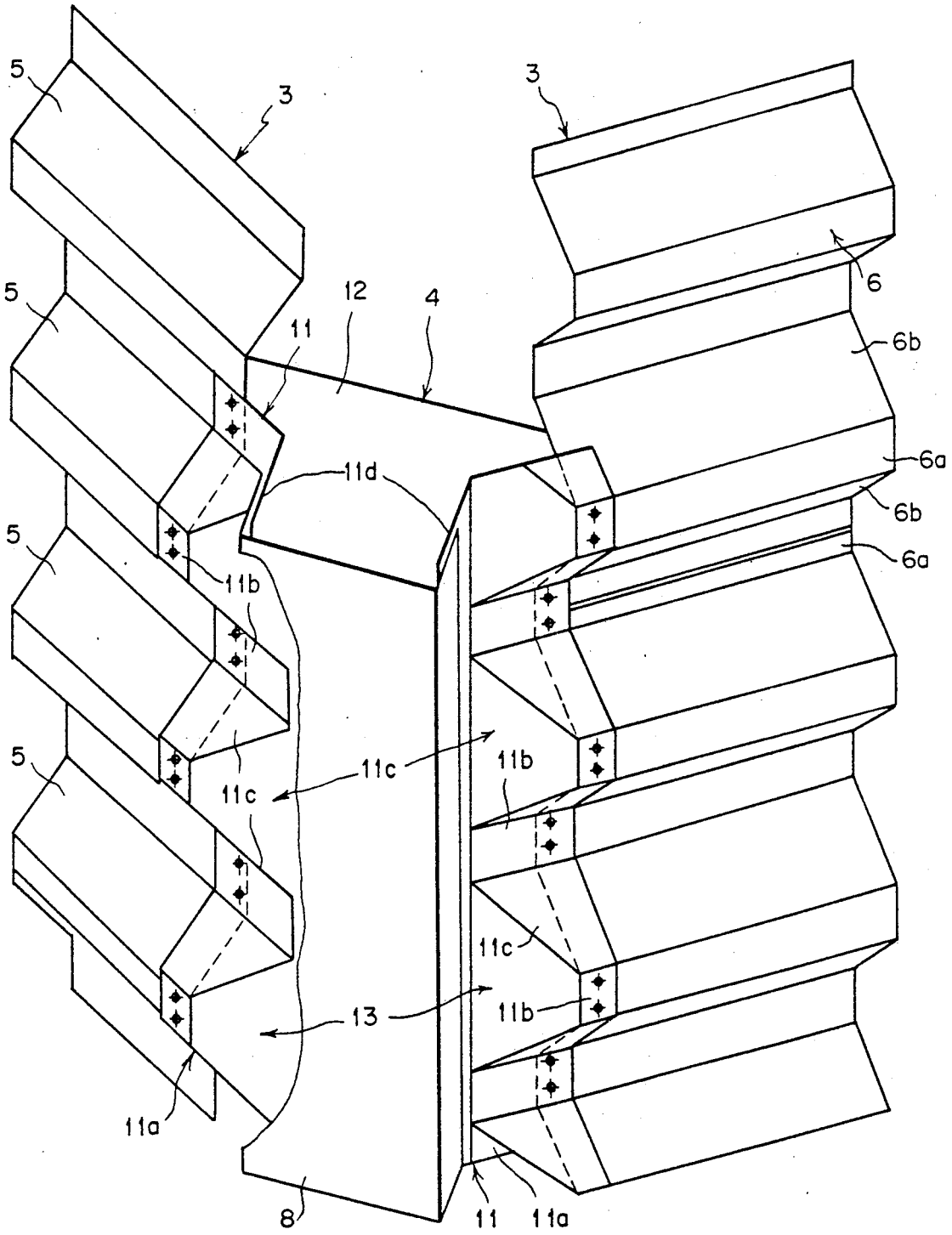
FIG. 3 is a perspective view of detail B of FIG. 1 shown as a cutout.

FIG. 3 shows the embodiment of a corner point, with two wall parts 3 being connected with each other at their inside faces by metal support plate 4. The hollow space denoted by reference numeral 12 is formed between support plate 4 and the two corner plates 11 interconnected by profile 8. Each corner plate 11 includes a leg 11*a*, which in each case abuts a wall part 3, and consists of a plurality of crimps 11*e* arranged one above the other. Crimps 11*e* have a shape which matches the form of crimps 6 of wall part 3 while outwardly projecting legs 11*d* of each corner plate 11 are engaged by profile 8. The hollow space 12 thus formed can be filled with concrete as well in order to increase stability.

Figure 6:
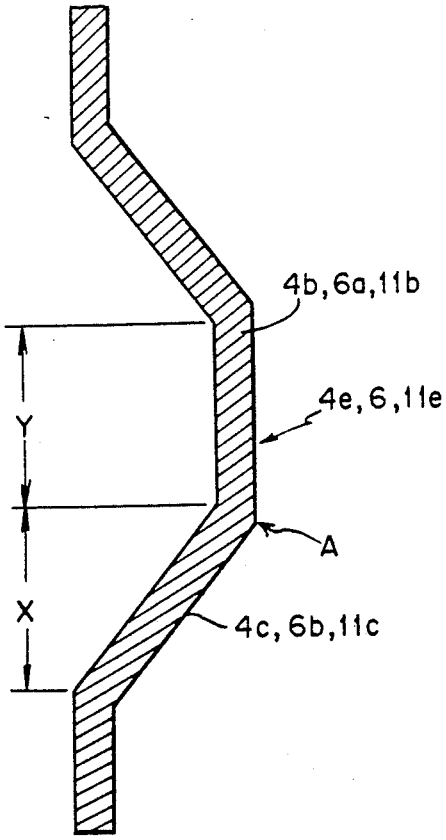
FIG. 6 is a cross-sectional view of a crimp.

The design of crimps 4*e*, 6 and 11*e* has been selected in such a way that the height Y of bridges 4*b*, 6*a* and 11*b* of a crimp conforms to the height X of legs 4*c*, 6*b* and 11*c*, as clearly seen in FIG. 6. This makes it possible to arrange two wall parts 3 positioned at right angles to each other and displaced with respect to each other by exactly the height Y of bridge 6*a* of crimp 6, so that pockets 13 are formed where crimps 6 of wall parts 3 merge into crimps 4*e* or 11*e*, pockets 13 being filled with concrete as well when hollow spaces 9 and 12 are filled with concrete. Such concrete-filled pockets 13 further increase the load absorption in the vertical direction.

FIGS. 4 and 5, and FIGS. 7 and 8 show how individual wall elements 5 of wall part 3 are connected with each other. In the present case, two wall elements 5 are joined in such a way that edge 5*a* of one wall element and edge 5*b* of the other wall element jointly form a form-locked connection.

Figure 4:
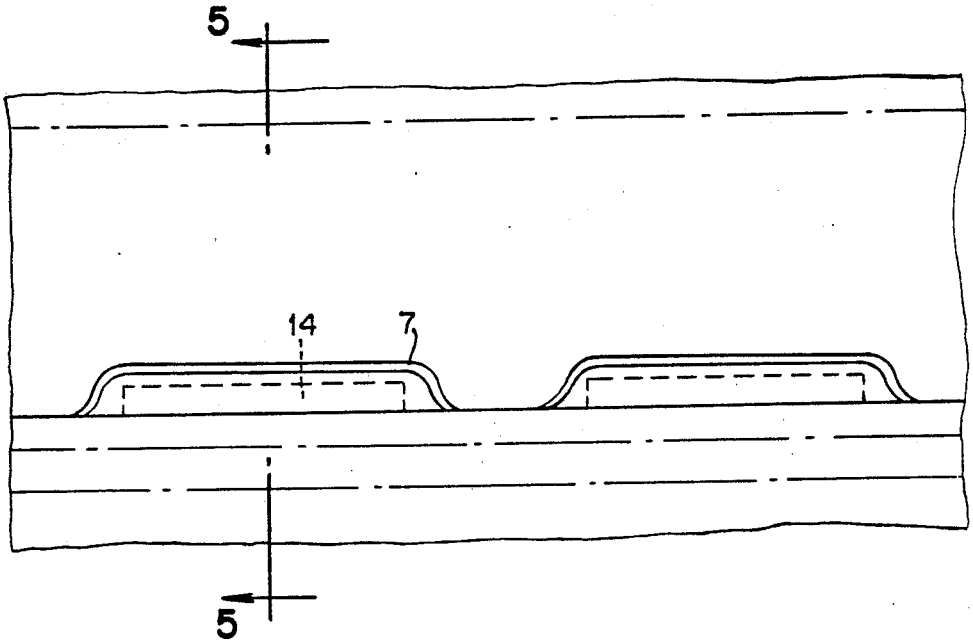
FIG. 4 is a front view of detail C of FIG. 2.
Figure 5:
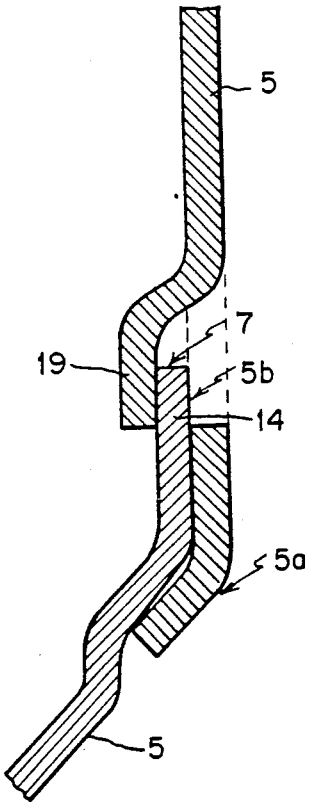
FIG. 5 is a cross-sectional view taken along line V—V of FIG. 4.

In the first embodiment of a form-locked connection between wall elements 5 as shown in FIGS. 4 and 5, provision is made for the roof-like openings denoted by reference numeral 7, with a claw or tab 14 of the corresponding other wall element 5 projecting into each opening. In this embodiment, wall element 5 having openings 7 overlaps the wall element having tabs 14 beyond the edge (arrow A in FIG. 6) of crimp 6. Complete tightness of the connection between two wall elements 5 is obtained by virtue of the roof-like openings 7, which have a slot only at the bottom for permitting the passage thereinto of tabs 14, but which are closed on all other sides.

Figure 7:
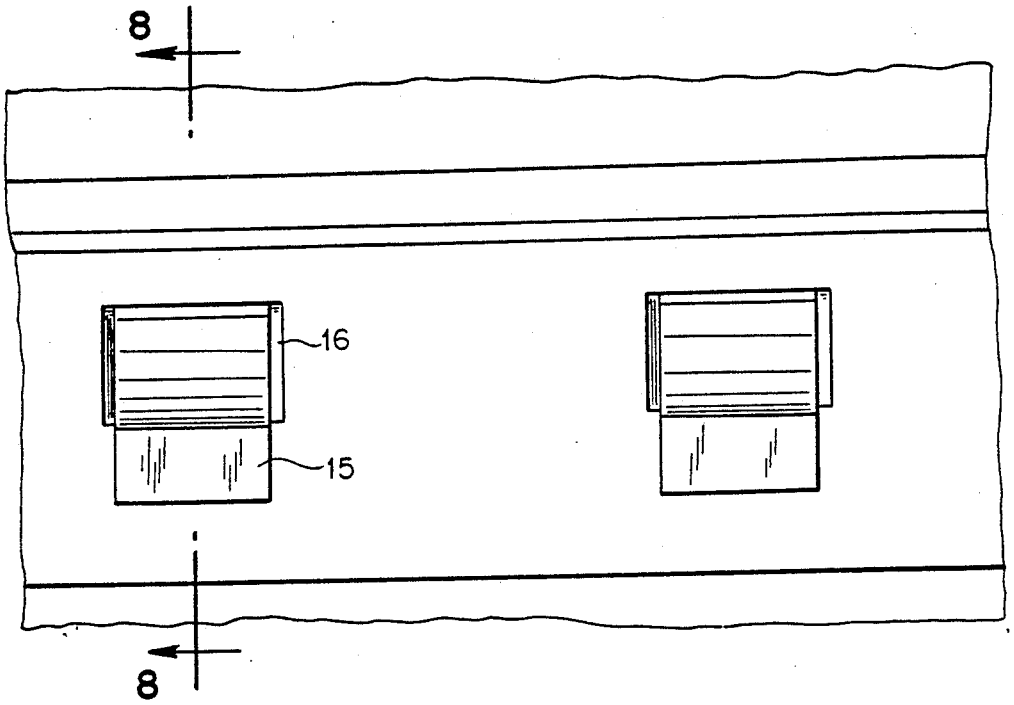
FIG. 7 is a view similar to that of FIG. 4 of another type of connection of two wall elements.
Figure 8:
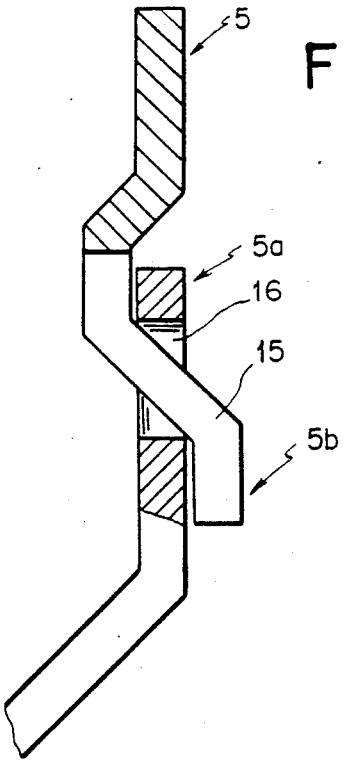
FIG. 8 is a cross-sectional view taken along line VIII—VIII of FIG. 7.

The second embodiment of the connection between two wall elements is clearly shown in FIGS. 7 and 8 and comprises the claws or tabs 15, which are angularly offset to project into openings 16. With this embodiment, the formlocked connection is produced particularly as a result of the angular offset of the claws or tabs.

While basically only a single embodiment of the present invention has been shown and described, it will be obvious that many changes and modifications may be made thereunto without departing from the spirit and scope of the invention.

What is claimed is:

1. A container, particularly a silo container, comprising a plurality of wall parts having a vertical height and having horizontal crimps extending therethrough substantially throughout the vertical height, wherein at least two of said wall parts form a region with a joint, at least one vertically standing support element connecting said at least two wall parts with each other at the joint, said at least one vertically standing support element formed as a metal support plate and having legs with crimps matching the crimps of said wall parts within the region of the joint for positively receiving the wall parts.

2. The container as defined in claim 1, wherein each said wall part is comprised of a plurality of wall elements arranged one above the other.

3. The container as defined in claim 1, wherein the horizontal crimps of said wall parts have a trapezoidal cross-section.

4. The container as defined in claim 1, wherein the metal support plate associated with a joint has a trapezoidal cross-section, wherein each leg of the metal support plate comprises crimps arranged one above the other.

5. The container as defined in claim 1, wherein said wall parts within the region of a joint form a spacing relative to each other.

6. The container as defined in claim 4, wherein at the junction of four walls parts standing vertically relative to each other, two adjacent wall parts are connected by a vertically standing metal support plate, forming a hollow space relative to the support plates.

7. The container as defined in claim 4, wherein in an angular joint a hollow space is formed in that two adjacent wall parts have a metal corner plate formed in an angular shape, an outwardly projecting leg of said plate being engaged by a U-shaped profile.

8. The container as defined in claim 7, wherein a second leg of the metal corner plate consists of a plurality of crimps arranged one above the other, said crimps conforming to the shape of the crimps of the wall part.

9. The container as defined in claim 4, wherein said legs are angled at approximately 45 degrees.

10. The container as defined in claim 7, wherein said legs are angled at approximately 45 degrees.

11. The container as defined in claim 1, wherein in a T-shaped joint, the outer wall part extends therethrough.

12. The container as defined in claim 4, wherein the crimp has a bridge; and wherein the height of the bridge of a crimp is the same as the height of the leg projected onto a plane.

13. The container as defined in claim 8, wherein the crimp has a bridge; and wherein the height of the bridge of a crimp is the same as the height of the leg projected onto a plane.

14. The container as defined in claim 12, wherein two wall parts are arranged at right angles relative to each other and displaced relative to each other by exactly the height of the bridge of a crimp so that pockets are formed where the crimps of the wall parts merge into the corresponding crimps of the metal support plates.

15. The container as defined in claim 13, wherein two wall parts are arranged at right angles relative to each other and displaced relative to each other by exactly the height of the bridge of a crimp so that pockets are formed where the crimps of the wall parts merge into the corresponding crimps of the metal support plates.

* * * * *